US008992167B2

(12) United States Patent
Casavant et al.

(10) Patent No.: US 8,992,167 B2
(45) Date of Patent: Mar. 31, 2015

(54) TURBINE CASING ASSEMBLY MOUNTING PIN

(75) Inventors: Matthew Stephen Casavant, Greenville, SC (US); Kenneth Damon Black, Travelers Rest, SC (US)

(73) Assignee: General Electric Company, Schenectady, NY (US)

( * ) Notice: Subject to any disclaimer, the term of this patent is extended or adjusted under 35 U.S.C. 154(b) by 748 days.

(21) Appl. No.: 13/226,823

(22) Filed: Sep. 7, 2011

(65) Prior Publication Data

US 2013/0058779 A1 Mar. 7, 2013

(51) Int. Cl.
*F01D 25/24* (2006.01)

(52) U.S. Cl.
CPC ..... *F01D 25/243* (2013.01); *Y10T 29/4932* (2013.01)
USPC ..... 415/173.1

(58) Field of Classification Search
CPC ..... F01D 25/243
USPC ..... 415/213.1, 230; 411/511, 513, 922; 403/16, 19, 259
See application file for complete search history.

(56) References Cited

U.S. PATENT DOCUMENTS

| | | | | |
|---|---|---|---|---|
| 3,083,863 | A * | 4/1963 | Sees | 220/683 |
| 3,746,463 | A * | 7/1973 | Stock et al. | 415/136 |
| 4,585,390 | A * | 4/1986 | Pirtle et al. | 415/160 |
| 4,832,574 | A * | 5/1989 | Woodwell et al. | 416/244 A |
| 5,271,714 | A | 12/1993 | Shepherd et al. | |
| 6,224,332 | B1 | 5/2001 | Leach et al. | |
| 6,402,468 | B1 | 6/2002 | Florin et al. | |
| 6,457,936 | B1 | 10/2002 | Leach et al. | |
| 7,520,721 | B2 | 4/2009 | Hamlin et al. | |
| 7,581,922 | B1 * | 9/2009 | Morimoto et al. | 415/126 |
| 2007/0041833 | A1 | 2/2007 | Dupin et al. | |
| 2009/0232651 | A1 | 9/2009 | Ballard, Jr. et al. | |
| 2010/0284792 | A1 | 11/2010 | Ballard, Jr. et al. | |

* cited by examiner

*Primary Examiner* — Nathaniel Wiehe
*Assistant Examiner* — Woody A Lee, Jr.
(74) *Attorney, Agent, or Firm* — Dority & Manning, PA

(57) ABSTRACT

In certain embodiments of the present disclosure a turbine casing assembly is described. The turbine casing assembly includes an inner casing and an outer casing surrounding the inner casing. The outer casing includes a first outer casing section and a second outer casing section that join together along a flange. Two bolts extend through the flange and join together the first outer casing section and the second outer casing section. A pin having a first segment having a first diameter and a second segment having a second diameter extends through the inner casing and the outer casing and supports the inner casing relative to the outer casing. The pin has a first diameter that is greater than the second diameter and is located between the two bolts along the axis of the flange.

9 Claims, 6 Drawing Sheets

TURBINE CASING ASSEMBLY MOUNTING PIN

FIELD OF THE INVENTION

The present invention generally involves a turbine casing assembly mounting pin and method for utilizing the same. In particular embodiments, a mounting pin joins an inner casing with an outer casing in a manner that reduces distortion and eccentricity between the inner and outer casings while transferring torque and gravity loads.

BACKGROUND OF THE INVENTION

Conventional turbine casings generally include one or more outer turbine casings that surround one or more inner turbine casings. The outer turbine casing is often split into two hemispherical casings bolted together by flanges on a horizontal plane to facilitate maintenance and repair. The inner turbine casing is often supported through to the outer turbine casing by one or more axially spaced circumferential arrays of pins Generally, active clearance controls are employed to radially displace inner and outer turbine casings from one another during transient turbine operations. This has the effect of controlling tip clearance between buckets and shrouds, which can be beneficial since decreasing tip clearance improves turbine performance by reducing tip leakage as long as bucket tips are prevented from transiently contacting and thereby rubbing shrouds.

With both active and passive systems in many configurations relative movement occurs between the inner and outer turbine casings due to differential thermal growth of their respective components. The aforementioned pins which are used to join the outer turbine casing with the inner turbine casing tangentially can reduce eccentricity caused by the relative movement. However, such pins can affect outer casing bolt spacing if the primary vertical support pins are placed near a preferred center-line supported configuration and thus intersect the outer casing bolted flange. Wider bolt spacing at the pinned locations can lead to horizontal joint overboard leakage and thus performance degradation.

Thus, a need exists for pins that allow for mounting of an inner turbine casing with an outer turbine casing without impacting outer turbine casing bolt spacing. Methods relating to such pins would also be beneficial.

BRIEF DESCRIPTION OF THE INVENTION

Aspects and advantages of the invention are set forth below in the following description, or may be obvious from the description, or may be learned through practice of the invention.

In certain embodiments of the present disclosure a turbine casing assembly is described. The turbine casing assembly includes an inner casing and an outer casing surrounding the inner casing. The outer casing includes an upper outer casing and a lower outer casing that join together along a flange. Two bolts extend through the flange and join together the upper outer casing and the lower outer casing. A pin having a bolt segment having a first diameter and a second diameter extends through the inner casing and the outer casing and supports the inner casing relative to the outer casing. The pin bolt segment first diameter is greater than the second diameter and is located between the two bolts along the axis of the flange.

In other embodiments of the present disclosure, a turbine is described. The turbine includes an inner casing and an outer casing. The inner casing carries nozzles and shrouds, the shrouds surrounding tips of buckets carried by a turbine rotor within the inner casing. The outer casing has an upper outer casing and a lower outer casing that join together along a flange. Two bolts extend through the flange and join together the upper outer casing and the lower outer casing. A pin having a bolt section having a first diameter and a second diameter extends through the inner casing and the outer casing and supports the inner casing relative to the outer casing. The first diameter is greater than the second diameter. The pin is located between the two bolts.

In still other embodiments of the present disclosure, a method for assembling a turbine casing is described. The method includes joining together an inner casing and an outer casing with a pin, the pin including a bolt section having a first diameter and a second diameter. The first diameter is greater than the second diameter, the pin extending through the inner casing and the outer casing. The method includes joining together an upper outer casing and a lower outer casing with two bolts, the pin being located between the two bolts. The method also includes surrounding the inner casing with the outer casing.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
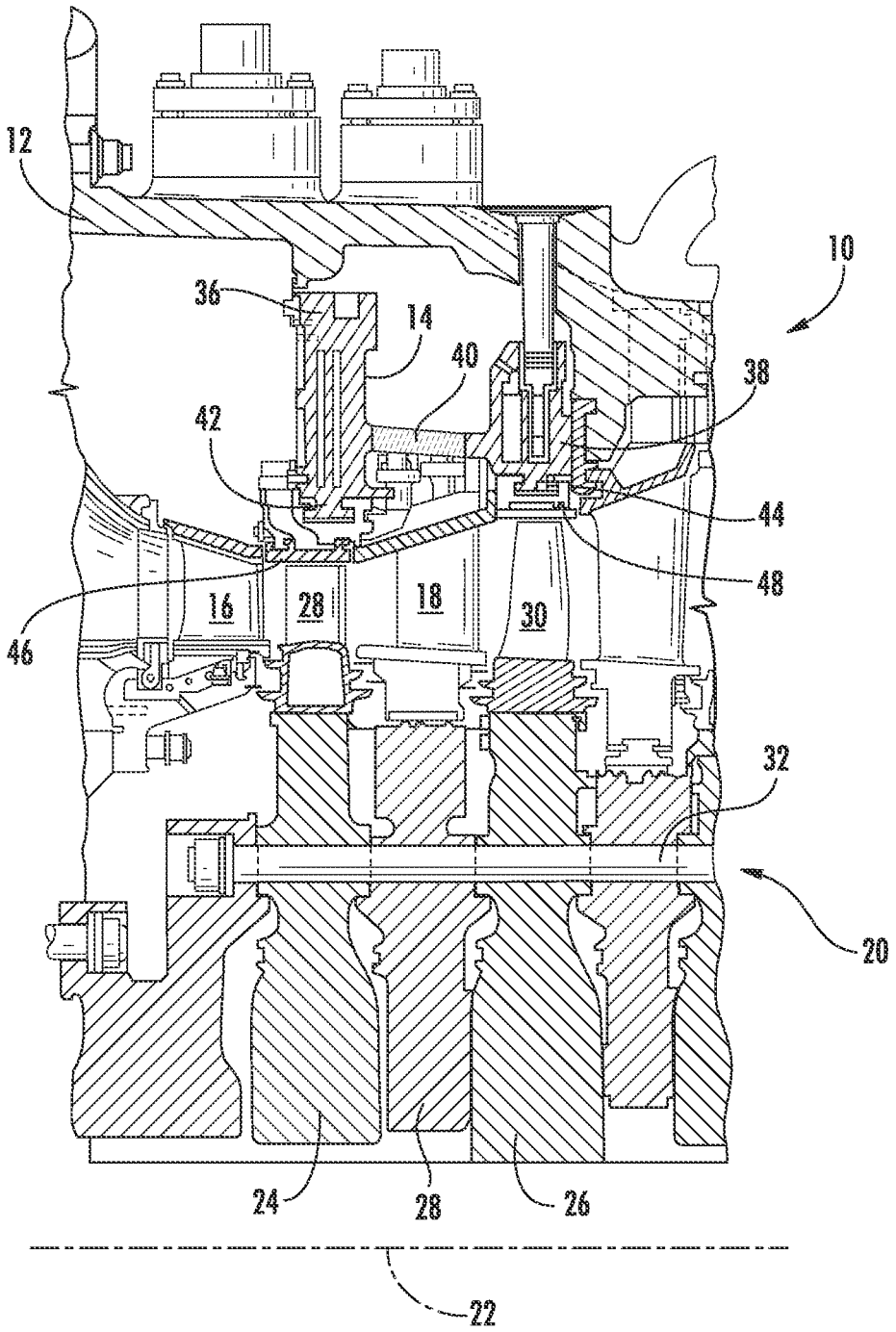
FIG. 1 is a cross-sectional perspective view of a turbine in accordance with certain embodiments of the present disclosure.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Referring to FIG. 1, there is illustrated a turbine casing assembly 10 cross-section, having an outer structural casing 12 and an inner casing 14 supported by the outer casing 12. The inner casing 14 carries an array of nozzles 16 and 18 forming parts of first and second stages, respectively, of the turbine. The inner casing 14 also surrounds a rotor, generally designated 20, rotatable about an axis 22. The rotor 20 includes circumferential arrays of buckets mounted on wheels arranged alternately with spacers, the wheels and spacers forming the body of the rotor. For example, the first and second-stage wheels 24 and 26 with an intervening spacer 28 are illustrated, the wheels 24 and 26 mounting buckets 28 and 30, respectively. It will be appreciated that the buckets and the nozzles of the various stages in part define the annular hot gas path through the turbine. The wheels and spacers of the rotor are secured to one another by bolts 32 circumferentially spaced one from the other about the rotor.

Figure 2:
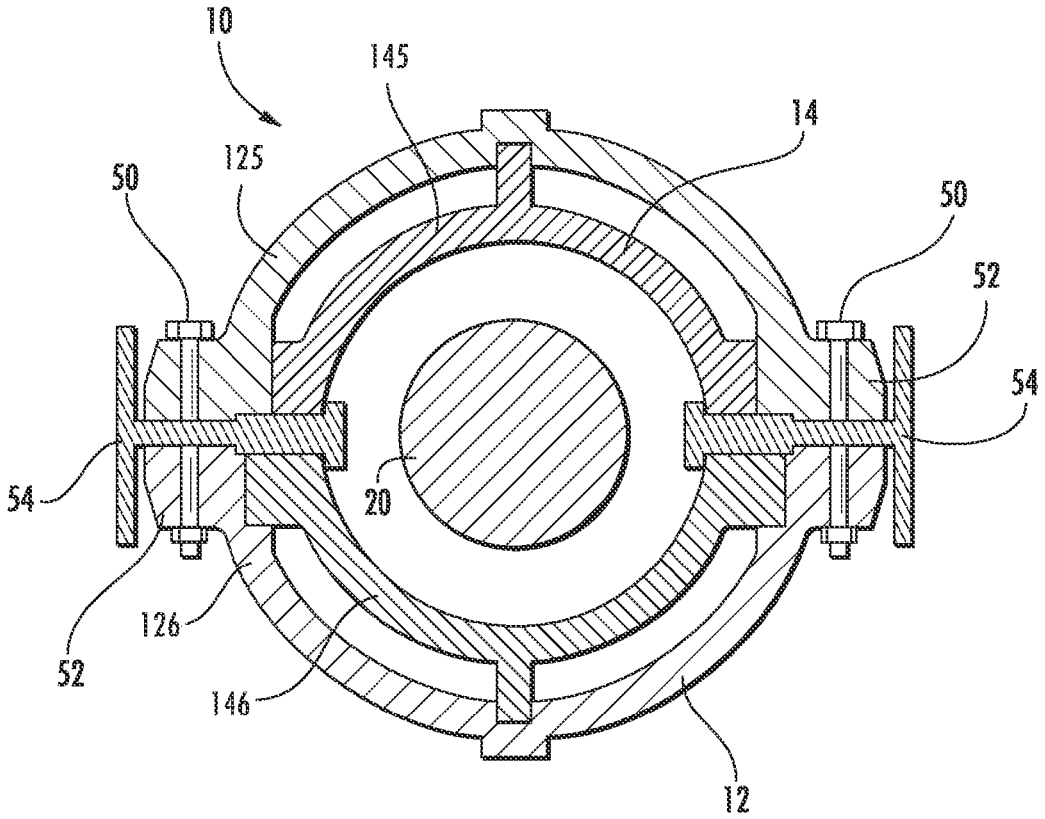
FIG. 2 is a cross-sectional schematic view of the turbine casing shown in FIG. 1 in accordance with certain aspects of the present disclosure.

FIG. 2 illustrates a schematic end view of an assembly 10 according to one embodiment of the present disclosure. The turbine assembly 10 generally includes one or more inner casings 14 and one or more outer casings 12. The one or more inner casings 14 and outer casings 12 are typically fabricated from alloys, superalloys, coated ceramics, or other material capable of withstanding temperatures associated with turbines. For example, a casing for a turbine in a gas turbine system would be fabricated from materials capable of withstanding temperatures associated with nozzle and shroud hook temperatures which are driven by among other factors combustion gases flowing through the gas turbine system.

Referring again to FIG. 1, the inner casing 14 comprises a forward section 36 and an aft section 38 interconnected by an axially extending annular rib 40. The forward and aft sections 36 and 38 are annular and have radially inwardly directed dovetails 42 and 44, respectively, for carrying shrouds 46 and 48. The shrouds provide a minimum clearance with the tips of the buckets. It will be appreciated that the inner casing 14 is secured to the outer casing along radial planes normal to the axis of the rotor and at axial locations, preferably in alignment with the first and second-stage buckets and shrouds.

The outer casing 14 generally surrounds the one or more inner casings 12 and together form the turbine 10. In this manner, the inner casings 12 generally conform to the outer perimeter of the rotating component, and the outer casing 14 provides an enclosure around the rotating component.

Referring again to FIG. 2, there is schematically illustrated a cross-sectional view of turbine 10 comprised of upper and lower outer casing casings 125 and 126 respectively, upper and lower inner casing casings 145 and 146 respectively and a rotor 20. Bolts 50 secure the upper and lower outer casing casings 125 and 126 to one another along a flange 52 that can extend across a section of the horizontal midline on either side of the turbine 10. With reference to bolts 50, as used herein, the term "bolts" refers to any structures such as a bolts, studs, pins, or the like that are positioned in flange bolt opening.

To support the inner casing relative to the outer casing, one or more pin assemblies 54 pass through the outer casing 12 for connection with the inner casing 14. For instance, the pin assemblies can pass through flange 52 of outer casing 12. One or more pin assemblies 54 can be spaced along each flange 52 that extends across a section of the horizontal midline on either side of the turbine 10.

Figure 3A:
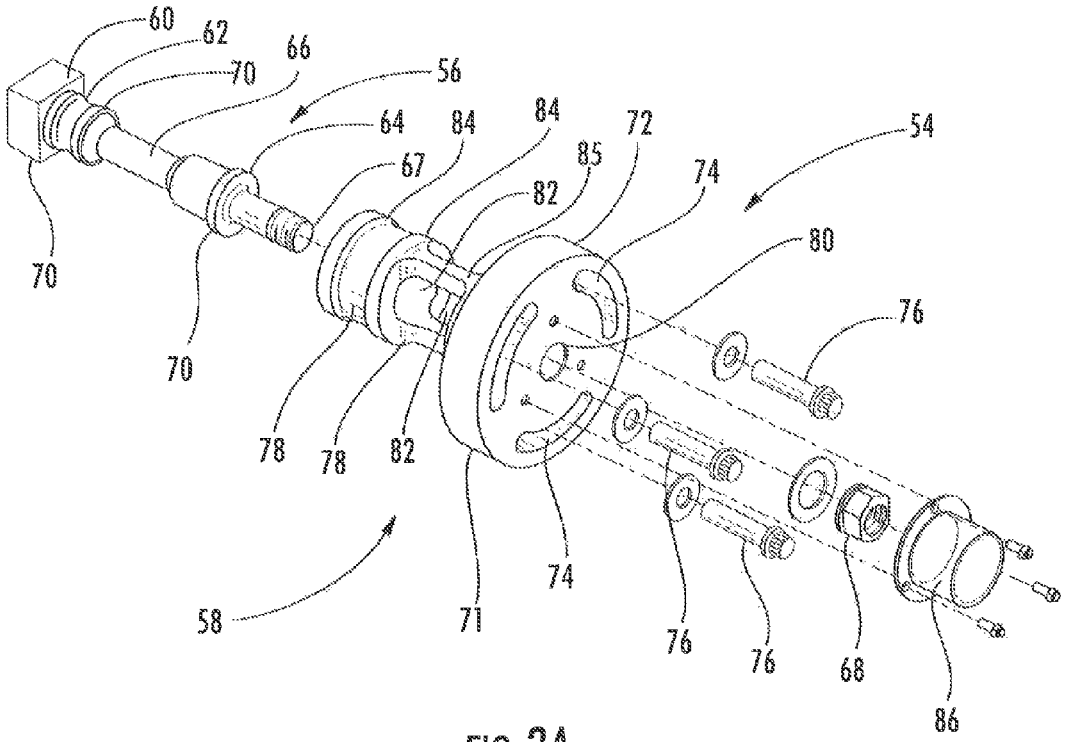
FIG. 3A illustrates an expanded view of a pin assembly in accordance with certain aspects of the present disclosure.
Figure 3B:
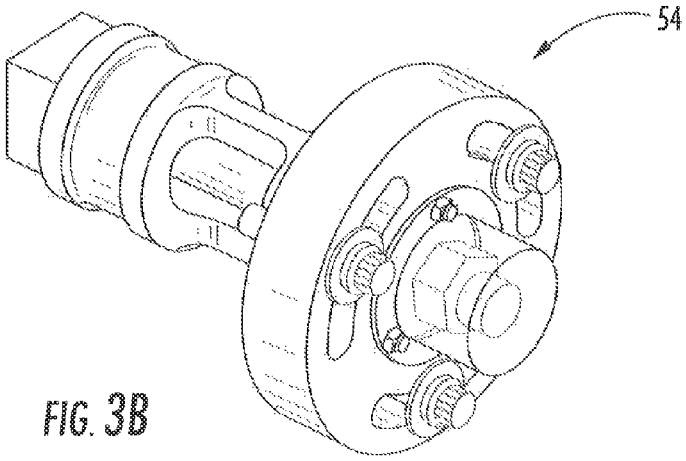
FIGS. 3B and 3C illustrate perspective views of a pin assembly in accordance with certain aspects of the present disclosure.
Figure 3C:
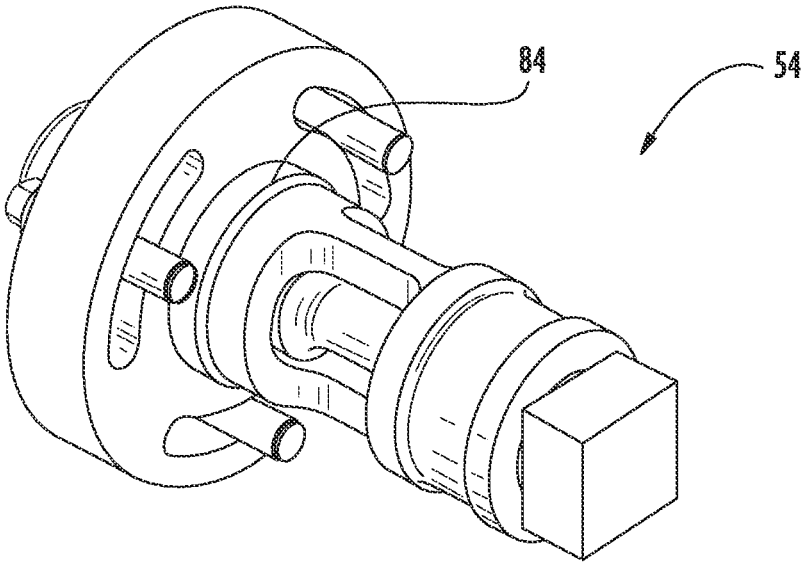

Referring to FIGS. 3A-3C, a pin assembly 54 is illustrated. The pin assembly 54 includes an inner pin portion 56 and an outer pin portion 58. The inner bore of the outer pin is eccentric to the outer diameter of the outer pin. This allows for the outer pin to be rotated and thus change the centerline location of the inner pin. Eccentric pins are often used in turbine systems to allow for precise external alignment capability of the inner casing relative to the rotor. Inner pin portion 56 includes an expanded ledge 60 on the radial innermost end 62 of the inner pin portion 56. Ledge 60 can have a generally square shape that interfaces with a complimentary female receiver defined by inner shell (shown in FIG. 2). Bolt section 64 extends from ledge 60 and can be generally cylindrical in shape. Bolt section 64 can include one or more contact pads 70 which allow for deterministic loading with outer pin portion 58. Bolt section 64 includes a section 66 having smaller diameter to accommodate pin assembly 54 being located between two bolts as will be further described herein. The outermost end 67 of inner pin portion 56 can define threads to receive an inner nut 68.

Outer pin portion 58 includes an enlarged head 71 having a bolt circle 72 with one or more circumferentially defined bolt openings 74. Bolt circle further defines an opening 80 that outermost end 67 of inner pin portion 56 can extend through. The bolt openings can be configured to receive one or more bolts 76 that react out pin rotation through friction which can set alignment of inner and outer turbine casings. Alignment portion 78 extends from bolt circle 72 and defines an opening (not shown) in communication with bolt circle opening 80 which can receive inner pin portion and also allow for outer pin rotations after assembly within the alignment requirements of the unit. Alignment portion includes contact pads 84 that allow deterministic loading with the inner and outer turbine casings and which are generally aligned with contact pads 70 of inner pin portion. Alignment portion includes one or more alignment scallops 82 which permit pin assembly 54 to be located between two bolts as will be further described herein. Alignment scallops 82 are defined, in part, by ridge portions 85 that each have a width that is approximately the same as or less than the diameter of section 66 of bolt section 64 to allow for outer pin rotations and subsequent inner pin eccentricity after assembly during unit alignment. In this manner, alignment portion 78 does not obstruct the bolts that secure the upper and lower outer casing casings.

When assembled, inner pin portion 56 can interface with an inner casing section and be joined to outer pin portion 58 which contacts outer casing through the outer casing flange. Inner nut 68 can secure inner pin portion 56 to outer pin portion 58 and can be covered by a bore cap 86 which is secured to bolt circle 72.

Figure 4:
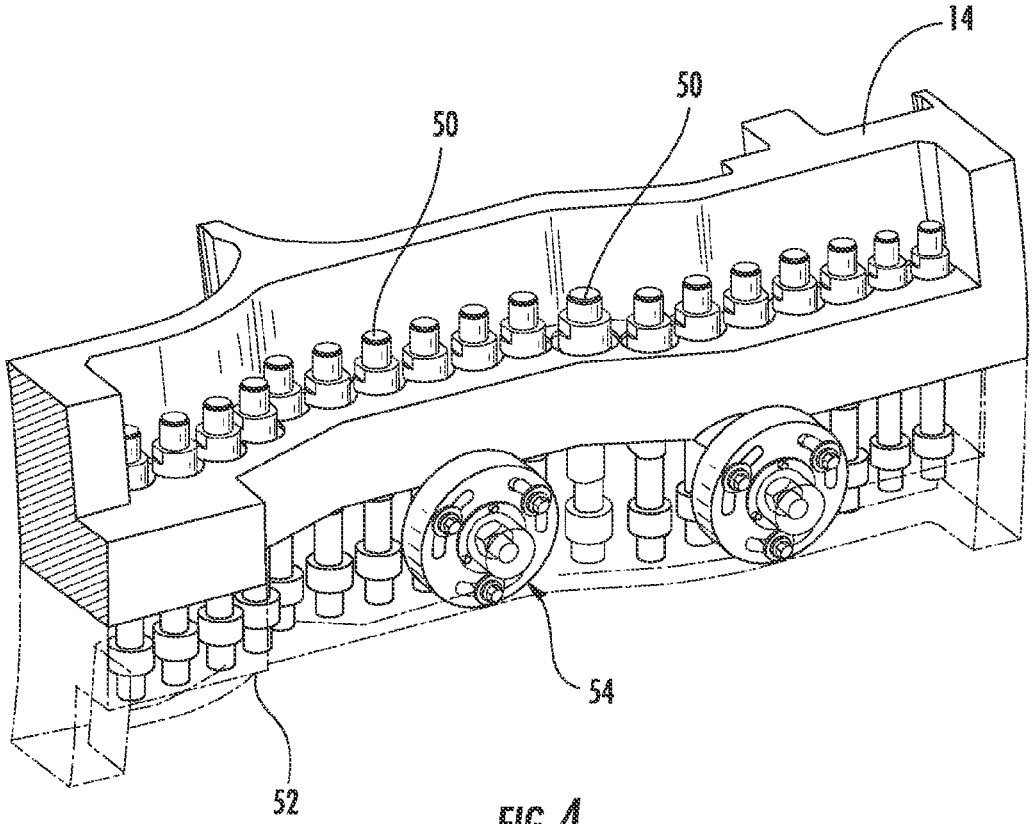
FIG. 4 illustrates a perspective view of a pin assembly positioned between bolts in accordance with certain aspects of the present disclosure.
Figure 5:
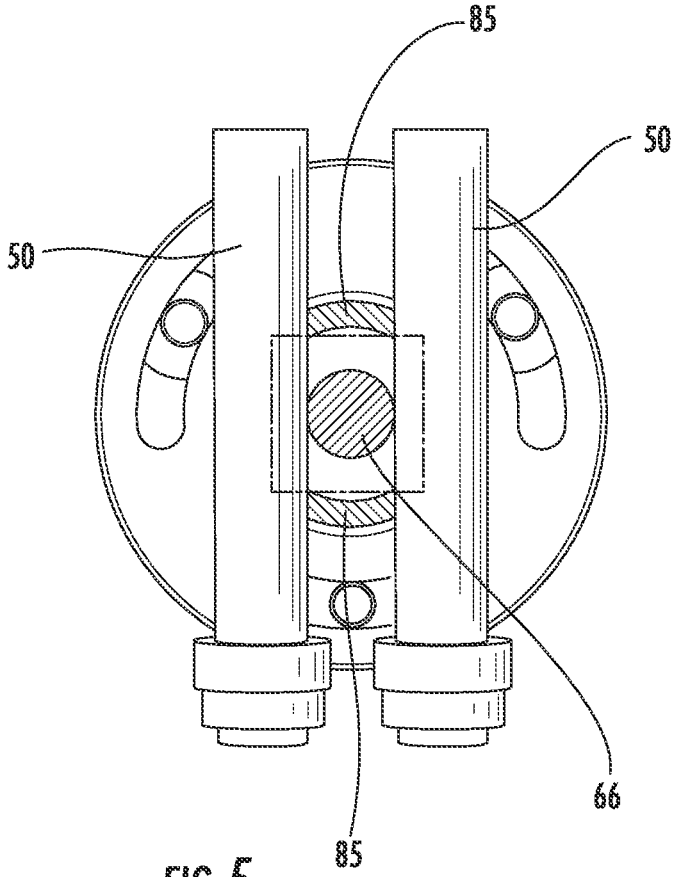
FIG. 5. illustrates a perspective view of a pin assembly positioned between bolts in accordance with certain aspects of the present disclosure

As illustrated in FIGS. 4 and 5, pin assembly 54 can be utilized for mounting and/or alignment of an inner turbine casing (not shown) through a horizontal joint flange 52 of outer turbine casing 14 without impacting outer casing bolt 50 spacing and/or leakage. For instance, as can be seen from FIG. 5, which represents a view in which the inner turbine casing and outer turbine casing are not shown, the section 66 and ridge portions 85 permit pin assembly to be located between bolts 50 which are utilized to secure the upper and lower outer casing casings.

One of ordinary skill in the art will readily appreciate that the structure previously described with respect to FIGS. 1-5 provides a method for assembling a turbine 10. The method generally includes joining the inner casing and the outer casing together with a pin assembly as described herein. A first outer casing section and a second outer casing section are joined together with two bolts. The inner casing is surrounded with the outer casing.

Empirical testing and computer-generated models indicate that various embodiments of the present disclosure can one or more benefits over existing turbine casing assembly mechanisms and methods. The pin assemblies described herein can provide a convenient and reliable structure for ensuring the inner casings 12 are concentrically attached to the outer casing 14 during assembly without impacting casing bolt spacing and/or leakage.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other and examples are intended to be within the scope of the claims if they include structural elements that do not differ from the literal language of the claims, or if they include equivalent structural elements with insubstantial differences from the literal languages of the claims.

What is claimed is:

1. A turbine casing assembly comprising:

an inner casing;

an outer casing surrounding the inner casing, wherein the outer casing is split into an upper outer casing having a first flange and a lower outer casing having a second flange that is adjacent to the first flange;

a first bolt and a second bolt, the first and second bolts extending adjacently through the first and second flanges; and a pin assembly that extends through the outer casing between the first and second bolts, the pin assembly having an inner pin portion that extends concentrically through an outer pin portion, the inner pin portion having a bolt section, the bolt section including a ledge defined at one end of the bolt section and a threaded portion defined at an opposing end of the bolt section, wherein the ledge is engaged with the inner casing and the threaded portion extends radially outwardly from the outer casing, the outer pin portion having a head portion and an alignment portion, the alignment portion including a first scalloped portion circumferentially separated from a second scalloped portion wherein the first bolt passes through the first scalloped portion and the second bolt passes through the second scalloped portion.

2. The turbine casing assembly as in claim 1, wherein a first portion of the bolt section of the inner pin has a first diameter and a second portion of the bolt section of the inner pin has second diameter that is smaller than the first diameter, wherein the second portion of the bolt section extends through the outer pin portion aligned with the first and second scalloped portions.

3. The turbine casing assembly as in claim 1, wherein the outer pin rotates in relation to the inner pin.

4. The turbine casing assembly as in claim 1, wherein the inner pin further comprises a contact pad which contacts the outer pin.

5. The turbine casing assembly as in claim 4, wherein the outer pin further comprises a contact pad, the outer pin contact pad being generally aligned with the inner pin contact pad, the outer pin contact pad contacting the outer turbine casing.

6. The turbine casing assembly as in claim 1, wherein the threaded portion of the bolt section extends through the head portion of the outer pin portion.

7. The turbine casing assembly as in claim 1, wherein the inner casing comprises a first inner casing and a second inner casing that join together along a flange.

8. The turbine casing assembly as in claim 1, wherein the first flange and the second flange define a horizontal joint of the outer casing.

9. The turbine casing assembly as in claim 1, wherein the first and second scalloped portions are circumferentially spaced from each other via a pair of circumferentially opposing ridges of the holt section.

* * * * *